US010809653B1

(12) United States Patent
Ohara et al.

(10) Patent No.: US 10,809,653 B1
(45) Date of Patent: Oct. 20, 2020

(54) IMAGE-FORMING-APPARATUS SLIDING MEMBER, FIXING DEVICE, AND IMAGE FORMING APPARATUS

(71) Applicant: FUJI XEROX CO., LTD., Tokyo (JP)

(72) Inventors: Hideaki Ohara, Kanagawa (JP); Fumio Daishi, Kanagawa (JP); Kenta Yamakoshi, Kanagawa (JP); Kenji Omori, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/743,697

(22) Filed: Jan. 15, 2020

(30) Foreign Application Priority Data

Sep. 25, 2019 (JP) ..... 2019-174010

(51) Int. Cl.
*G03G 15/20* (2006.01)
*G03G 15/08* (2006.01)

(52) U.S. Cl.
CPC ..... *G03G 15/2053* (2013.01); *G03G 15/0808* (2013.01); *G03G 15/2007* (2013.01); *G03G 15/2064* (2013.01)

(58) Field of Classification Search
CPC ..... G03G 15/2007; G03G 15/2025; G03G 15/2053; G03G 15/206; G03G 15/2064; G03G 15/0808
See application file for complete search history.

(56) References Cited

U.S. PATENT DOCUMENTS

2009/0052956 A1* 2/2009 Okuno ..... G03G 15/206 399/329
2017/0102646 A1* 4/2017 Ikebuchi ..... G03G 15/2025
2019/0265617 A1* 8/2019 Kataoka ..... G03G 15/2025
2019/0339641 A1* 11/2019 Takezawa ..... G03G 15/2028
2019/0377286 A1* 12/2019 Naitoh ..... G03G 15/2025
2020/0026229 A1* 1/2020 Hoshio ..... G03G 15/2053
2020/0041939 A1* 2/2020 Imazu ..... G03G 15/2025

FOREIGN PATENT DOCUMENTS

JP 2004-206105 A 7/2004
JP 2005-003969 A 1/2005
JP 2005241765 A * 9/2005
JP 2010-211220 A 9/2010
JP 2017040885 A * 2/2017

OTHER PUBLICATIONS

Machine translation of JP 2005-241965 A (a publication date of Sep. 8, 2005) printed on May 28, 2020.*
Machine translation of JP 2017-040885 A (a publication date of Feb. 23, 2017) printed on May 28, 2020.*

* cited by examiner

*Primary Examiner* — Sophia S Chen
(74) *Attorney, Agent, or Firm* — Sughrue Mion, PLLC

(57) ABSTRACT

An image-forming-apparatus sliding member includes a woven base and a cover layer disposed on at least one surface of the woven base. The average height of projections and depressions on a sliding surface is greater than or equal to 40 μm and smaller than or equal to 90 μm, and an average distance between the projections and the depressions is greater than or equal to 700 μm and smaller than or equal to 1600 μm.

14 Claims, 4 Drawing Sheets

IMAGE-FORMING-APPARATUS SLIDING MEMBER, FIXING DEVICE, AND IMAGE FORMING APPARATUS

CROSS-REFERENCE TO RELATED APPLICATIONS

This application is based on and claims priority under 35 USC 119 from Japanese Patent Application No. 2019-174010 filed Sep. 25, 2019.

BACKGROUND

(i) Technical Field

The present disclosure relates to an image-forming-apparatus sliding member, a fixing device, and an image forming apparatus.

(ii) Related Art

Japanese Unexamined Patent Application Publication No. 2004-206105 discloses "an electrophotographic-apparatus sliding member having a sliding surface, at least the sliding surface being formed from a nonporous sheet containing a heat-resistant resin".

Japanese Unexamined Patent Application Publication No. 2005-003969 discloses "a sliding member that is in contact with an inner surface of a hollow rotator driven by a predetermined driving member, the sliding member slidably moving in response to the driven movement of the hollow rotator, the sliding member having a sliding surface that is in contact with the inner surface of the hollow rotator, at least the sliding surface being formed from a fluororesin composite, the sliding surface having projections and depressions repeatedly arranged in at least the direction in which the hollow rotator is driven".

Japanese Unexamined Patent Application Publication No. 2010-211220 discloses "a fixing device including a rotatable rotary member, a rotatable resin-film hollow cylinder disposed in pressure contact with the rotary member to form a nip portion between itself and the rotary member, the resin-film hollow cylinder holding at the nip portion a recording medium carrying an unfixed toner image to fix the unfixed toner image to the recording medium, a pressing member disposed on the inner side of the resin-film hollow cylinder to press the resin-film hollow cylinder against the rotary member, and a sheet-shaped sliding member interposed between the resin-film hollow cylinder and the pressing member, the sheet-shaped sliding member having at least a sliding surface formed from a nonporous sheet containing a heat-resistant resin, the nonporous sheet being disposed on a base having projections and depressions on its surface".

SUMMARY

Examples of a fixing device included in an image forming apparatus include a fixing device that holds a recording medium between two rotators to fix an image on the recording medium. In the fixing device, the two rotators rotate while a pressing member disposed in one of the rotators exerts pressure on an area over which the recording medium is to be held (hereinafter also referred to as "a holding area"), so that the recording medium to which an image has been fixed is discharged out of the holding area. The rotator in which the pressing member is disposed includes a sliding member between the pressing member and the inner circumferential surface of the rotator to, for example, smoothly rotate the rotator, and a lubricant interposed between the inner circumferential surface of the rotator and a surface of the sliding member (hereinafter also referred to as "a sliding surface") that is in contact with the inner circumferential surface of the rotator.

Compared to the structure where no lubricant is interposed, the structure where a lubricant is interposed reduces sliding resistance between the rotator and the sliding member, and thus reduces the driving torque of the rotator. However, even with the interposition of the lubricant, a continuous rotation of the rotator consumes the lubricant, and may raise the driving torque.

To reduce consumption of the lubricant, another conceivable example of the method for facilitating holding of the lubricant on a sliding surface is to use a sliding member having projections and depressions on its sliding surface. However, the projections and depressions on the sliding surface may affect the brightness on the image fixed to the recording medium through the rotator.

Aspects of non-limiting embodiments of the present disclosure relate to an image-forming-apparatus sliding member including a woven base and a cover layer disposed on at least one surface of the woven base. The image-forming-apparatus sliding member prevents a rise of the driving torque during continuous sliding while a lubricant is held on a sliding surface, and prevents the brightness of the formed image from varying, compared to the case where the projection/depression average height on the sliding surface is below 40 μm or over 90 μm, or the average distance between projections and depressions is below 700 μm or over 1600 μm.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there are provided the following members.

An image-forming-apparatus sliding member includes a woven base and a cover layer disposed on at least one surface of the woven base. The average height of projections and depressions on a sliding surface is greater than or equal to 40 μm and smaller than or equal to 90 μm, and an average distance between the projections and the depressions is greater than or equal to 700 μm and smaller than or equal to 1600 μm.

BRIEF DESCRIPTION OF THE DRAWINGS

Exemplary embodiments of the present disclosure will be described in detail based on the following figures, wherein.

DETAILED DESCRIPTION

Figure 1:
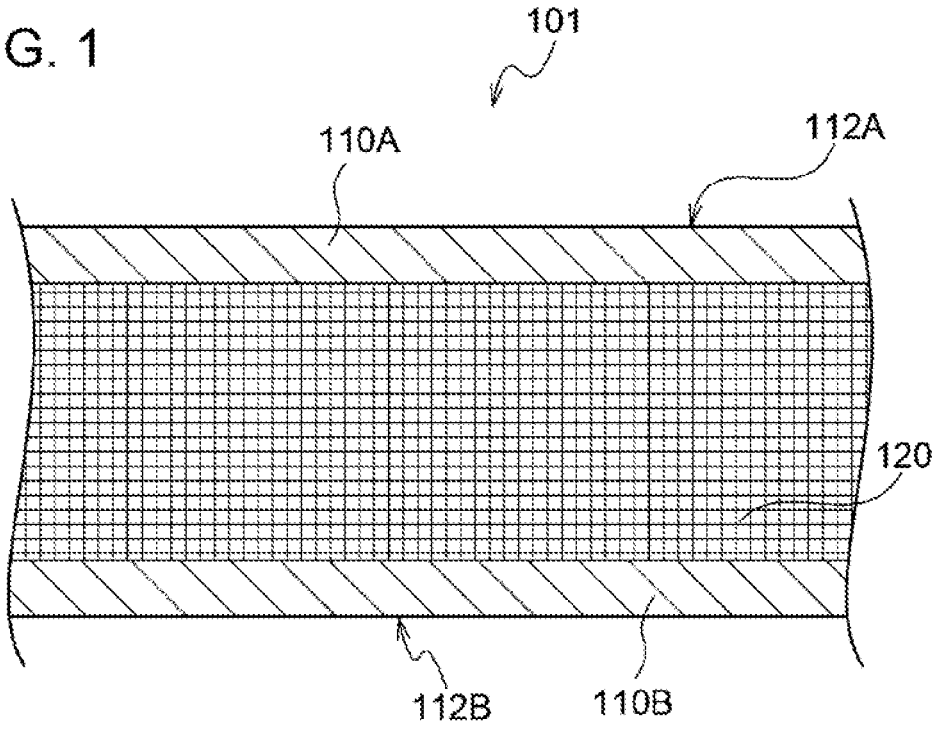
FIG. 1 is a schematic diagram of an example of a structure of an image-forming-apparatus sliding member according to the present exemplary embodiment.

Hereinbelow, an image-forming-apparatus sliding member, a fixing device, and an image forming apparatus according to the present exemplary embodiment will be described in detail. Image-Forming-Apparatus Sliding Member First Aspect An image-forming-apparatus sliding member (hereinafter also simply referred to as a "sliding member") according to a first aspect includes a woven base and a cover layer disposed on at least one surface of the woven base. The projection/depression average height on a sliding surface is greater than or equal to 40 μm and smaller than or equal to 90 μm, and the average distance between projections and depressions is greater than or equal to 700 μm and smaller than or equal to 1600 μm.

The above structure according to the first aspect prevents a rise of the driving torque during continuous sliding while a lubricant is held on a sliding surface, and prevents the brightness of the formed image from varying. The reason for these effects is not clear, but is assumed as follows.

Image-forming-apparatus sliding members have been used as, for example, sliding members for a fixing device. The fixing device includes, for example, a pressure-applying member as a first rotator, and an endless belt as a second rotator. The pressure-applying member and the endless belt form a holding area (that is, a nip portion). To increase the width of the holding area, a pressing member (such as a pressing pad) that presses the endless belt is disposed inside the endless belt. To enhance the sliding performance of the pressure-applying member and the endless belt, a sliding member is interposed between the endless belt and the pressing member. To facilitate smooth rotation of the endless belt, a lubricant is interposed between the sliding surface (that is, a surface that is in contact with the inner circumferential surface of the endless belt) of the sliding member and the inner circumferential surface of the endless belt.

However, even with the interposition of the lubricant, a continuous operation of the fixing device gradually consumes the lubricant on the sliding surface, and may raise the driving torque of the endless belt with a rise of the coefficient of friction on the sliding surface.

To reduce the consumption of the lubricant, another conceivable example of the method for facilitating holding of the lubricant on the sliding surface is to use a sliding member having a sliding surface having projections and depressions. However, the surface having projections and depressions may cause a pressure difference the holding area between the portions corresponding to the projections of the sliding member and portions corresponding to the depressions of the sliding member, and the brightness of an image fixed to the recording medium may vary.

The sliding member according to the first aspect, on the other hand, has a sliding surface having projections and depressions an average height of which is greater than or equal to 40 μm and smaller than or equal to 90 μm, and an average distance between any two of which is greater than or equal to 700 μm and smaller than or equal to 1600 μm. Compared to the case where the projection/depression average height is below 40 μm, or the average distance between any two of projections and depressions is below 700 μm, the projections and depressions form larger recesses to hold a larger amount of the lubricant in the recesses of the sliding surface. Thus, it is assumed that the coefficient of friction on the sliding surface is kept low, so that the rise of the driving torque is prevented. Compared to the case where the projection/depression average height is over 90 μm, or the average distance between any two of projections and depressions is over 1600 μm, it is assumed that the pressure difference in the holding area due to the projections and depressions is small, and the brightness of the fixed image is prevented from varying.

From the above reasons, it is assumed that the first aspect prevents a rise of the driving torque during continuous sliding while a lubricant is held on a sliding surface, and prevents the brightness of the formed image from varying.

Second Aspect

A sliding member according to a second aspect includes a woven base containing a weaving yarn having an average diameter of greater than or equal to 20 μm and smaller than or equal to 100 μm, and a cover layer disposed on at least one surface of the woven base, and having an average thickness of greater than or equal to 25 μm and smaller than or equal to 60 μm.

The second aspect having the above structure prevents a rise of the driving torque during continuous sliding while a lubricant is held on a sliding surface, and prevents the brightness of the formed image from varying. The reason for these effects is not clear, but is assumed as follows.

Image-forming-apparatus sliding members have been used as, for example, sliding members for a fixing device. The fixing device includes, for example, a pressure-applying member as a first rotator, and an endless belt as a second rotator. The pressure-applying member and the endless belt form a holding area (that is, a nip portion). To increase the width of the holding area, a pressing member (such as a pressing pad) that presses the endless belt is disposed inside the endless belt. To enhance the sliding performance of the pressure-applying member and the endless belt, a sliding member is interposed between the endless belt and the pressing member. To facilitate smooth rotation of the endless belt, a lubricant is interposed between the sliding surface (that is, a surface that is in contact with the inner circumferential surface of the endless belt) of the sliding member and the inner circumferential surface of the endless belt.

As described above, even with the interposition of the lubricant, a continuous operation of the fixing device gradually consumes the lubricant on the sliding surface, and may raise the driving torque of the endless belt with a rise of the coefficient of friction on the sliding surface. If a sliding member having projections and depressions on a sliding surface is used to reduce the consumption of the lubricant, a pressure difference may occur in the holding area between the portions corresponding to the projections of the sliding member and portions corresponding to the depressions of the sliding member, and the brightness of an image fixed to the recording medium may vary.

The sliding member according to the second aspect, on the other hand, includes the woven base formed from a weaving yarn having an average diameter of greater than or equal to 20 μm and smaller than or equal to 100 μm, and the cover layer having an average thickness of greater than or equal to 25 μm and smaller than or equal to 60 μm. Compared to the case where the average diameter of the weaving yarn falls below the above range and the average thickness of the cover layer is within the above range, larger projections and depressions are more likely to be formed on the sliding surface. Thus, a larger amount of the lubricant is held in the recesses of the sliding surface formed by the projections and depressions, and the coefficient of friction on the sliding surface is kept low. It is thus assumed that the rise of the driving torque is prevented. Compared to the case where the average diameter of the weaving yarn exceeds the above range, and the average thickness of the cover layer falls within the above range, it is assumed that the pressure difference in the holding area due to the projections and depressions is reduced with the appropriate size of the projections and depressions, and the brightness of the fixed image is prevented from varying.

From the above reasons, it is assumed that the second aspect prevents a rise of the driving torque during continuous sliding while a lubricant is held on a sliding surface, and prevents the brightness of the formed image from varying.

Hereinbelow, a sliding member corresponding to each of the sliding member according to the first aspect and the sliding member according to the second aspect is referred to as "a sliding member according to the present exemplary embodiment". However, an example of a sliding member according to an aspect of the present disclosure may correspond to at least one of the sliding member according to the first aspect and the sliding member according to the second aspect.

The sliding member according to the present exemplary embodiment will now be described with reference to the drawings.

In the following description, a sliding member including a base and cover layers disposed on both surfaces of the base will be described by way of example.

FIG. 1 schematically illustrates an example of a structure of the sliding member according to the present exemplary embodiment. A sliding member 101 illustrated in FIG. 1 includes a base 120, which is a woven base, a first cover layer 110A, disposed on a first surface of the base 120, and a second cover layer 110B, disposed on a second surface of the base 120. When the first cover layer 110A is to come into contact with a receiving member, the surface of the first cover layer 110A (surface opposite to the surface facing the base 120) serves as a sliding surface 112A. When the second cover layer 110B is to come into contact with the receiving member, the surface of the second cover layer 110B (surface opposite to the surface facing the base 120) serves as a sliding surface 112B. Specifically, the sliding surface is a surface over which the cover layer is exposed.

In FIG. 1, a sliding member including the base 120, and the first cover layer 110A and the second cover layer 110B disposed on both surfaces of the base is described by way of example. However, the sliding member 101 according to the present exemplary embodiment is not limited to this aspect. In another aspect, a cover layer may be disposed on only a single surface of the base 120 (for example, on only the cover layer 110A), and the surface of the cover layer (surface opposite to the surface facing the base 120) may serve as a sliding surface.

As descried above, the sliding member according to a first aspect has a sliding surface having projections and depressions an average height of which is greater than or equal to 40 μm and smaller than or equal to 90 μm, and an average distance between which is greater than or equal to 700 μm and smaller than or equal to 1600 μm. For example, as in the sliding member 101 illustrated in FIG. 1, for a sliding member having multiple prospective sliding surfaces, it will suffice that one of the multiple prospective sliding surfaces satisfies the above conditions (specifically, the projection/depression average height and the average distance between projections and depressions), and both of the multiple prospective sliding surfaces may satisfy the above conditions.

In the sliding member according to the second aspect, as described above, the cover layer has an average thickness of greater than or equal to 25 μm and smaller than or equal to 60 μm. For example, as in the case of the sliding member 101 illustrated in FIG. 1, for the sliding member including multiple cover layers, it will suffice that one of the multiple cover layers satisfies the above conditions (specifically, the average thickness), and both of the multiple cover layers may satisfy the above conditions. Projection/Depression Average Height and Average Distance between Projections and Depressions Hereinbelow, the projection/depression average height on the sliding surface and the average distance between projections and depressions on the sliding surface will be described with reference to the drawings.

Figure 2:
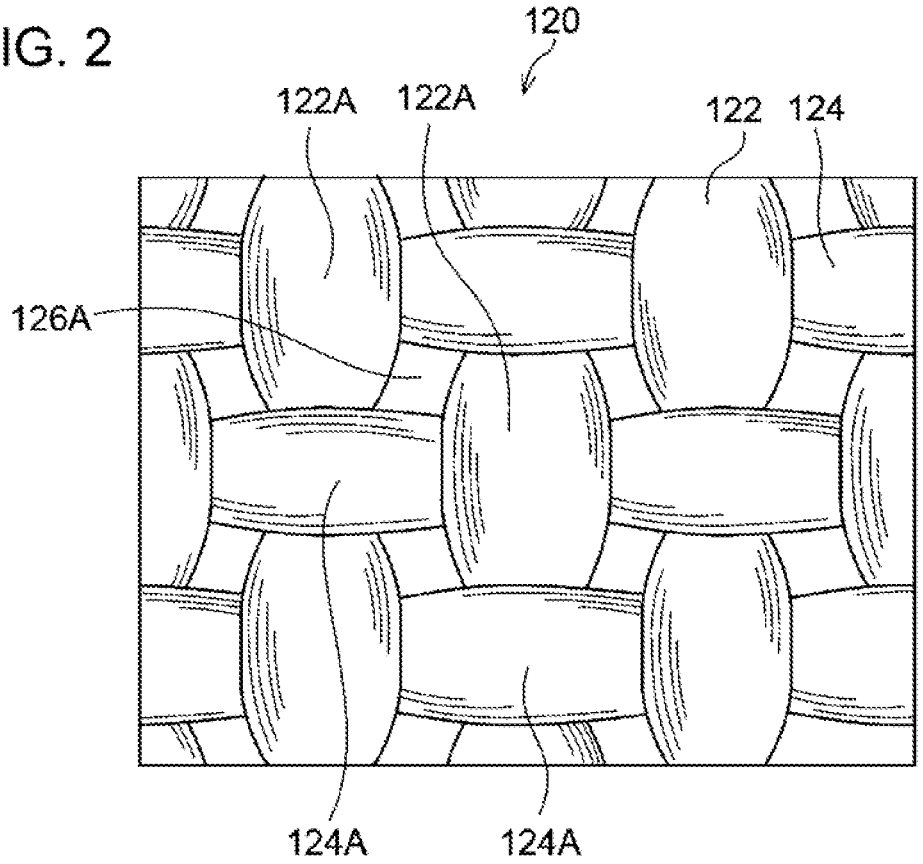
FIG. 2 is an enlarged schematic diagram of a cover-layer installed surface of a woven base forming a sliding member according to the present exemplary embodiment.

FIG. 2 is an enlarged schematic diagram of a surface of the woven base constituting the sliding member according to the present exemplary embodiment, on which surface the cover layer having a sliding surface is disposed (hereinafter the surface is also referred to as "a cover-layer installed surface").

The base 120 illustrated in FIG. 2 is woven in a plain weave with warp 122 and weft 124. On the cover-layer installed surface of the base 120, portions where the warp 122 and the weft 124 cross each other form projections, and portions where neither the warp 122 nor the weft 124 lies form depressions.

The projections and depressions on the cover-layer installed surface of the base 120 are reflected on the sliding surface of the sliding member, which is included in the cover layer disposed on the cover-layer installed surface of the base 120. Specifically, for example, also on the sliding surface of the sliding member, the portions of the base 120 corresponding to the projections of the cover-layer installed surface form projections, and the portions of the base 120 corresponding to the depressions of the cover-layer installed surface form depressions.

Here, the projections of the cover-layer installed surface of the base 120 include two types, that is, warp-exposed projections 122A, in each of which the warp 122 is exposed over the cover-layer installed surface, and weft-exposed projections 124A, in each of which the weft 124 is exposed over the cover-layer installed surface. On the base 120, the warp-exposed projections 122A have approximately the same height, and the weft-exposed projections 124A have approximately the same height, but the warp-exposed projections 122A and the weft-exposed projections 124A have different heights. Thus, also on the sliding surface of the sliding member having the cover layer disposed on the cover-layer installed surface of the base 120, the portions corresponding to the warp-exposed projections 122A and the portions corresponding to the weft-exposed projections 124A have different heights.

For example, when the warp-exposed projections 122A are higher than the weft-exposed projections 124A on the cover-layer installed surface of the base 120, the portions corresponding to the warp-exposed projections 122A are higher than the portions corresponding to the weft-exposed projections 124A on the sliding surface of the sliding member.

The projection/depression average height on the sliding surface and the average distance between the projections and depressions are calculated from the height of higher portions between the portions corresponding to the warp-exposed projections 122A and the portions corresponding to the weft-exposed projections 124A (specifically, the portions protruding further from the sliding surface). For example, when the portions corresponding to the warp-exposed projections 122A are higher than the portions corresponding to the weft-exposed projections 124A on the sliding surface of the sliding member, the projection/depression average height on the sliding surface and the average distance between projections and depressions are calculated from the height of the portions corresponding to the warp-exposed projections 122A (instead of the portions corresponding to the weft-exposed projections 124A).

Hereinbelow, a method of calculating the projection/depression average height on the sliding surface and the average distance between projections and depressions is described using an example where the portions corresponding to the warp-exposed projections 122A are higher than the portions corresponding to the weft-exposed projections 124A.

The "projection/depression average height" is calculated at five points of the sliding surface of the sliding member by averaging the height difference (height difference in the thickness direction of the sliding member) between portions corresponding to a specific warp-exposed projection 122A and a portion corresponding to a depression 126A closest to the specific warp-exposed projection 122A. Specifically, in the thickness direction of the sliding member, the difference between the largest height of the portion corresponding to the specific warp-exposed projection 122A and the smallest height of the portion corresponding to the depression 126A is referred to as the "height difference".

The "average distance between projections and depressions" is calculated at five points of the sliding surface of the sliding member by averaging the distance (distance in the plane direction of the sliding member) between a portion corresponding to a specific warp-exposed projection 122A and another portion corresponding to the warp-exposed projection 122A closest to the specific warp-exposed projection 122A. Specifically, the distance between the point, highest in the thickness direction of the sliding member, of the portion corresponding to the specific warp-exposed projection 122A and the point, highest in the thickness direction of the sliding member, of the portion corresponding to an adjacent warp-exposed projection 122A is referred to as the "distance". Specifically, the distance between the highest points of two portions corresponding to the warp-exposed projections 122A illustrated in FIG. 2 is referred to as the "distance".

The "height difference" and the "distance" are calculated using, for example, a projection/depression curve of the sliding surface, which is obtained by observing the sliding surface of the sliding member with a laser microscope (Product No. VK-9700 from Keyence Corporation, under the conditions of 3-D shape measurement mode).

The projection/depression average height on the sliding surface is greater than or equal to 40 μm and smaller than or equal to 90 μm, or preferably, from the viewpoint of preventing a rise of the driving torque and preventing the brightness from varying, greater than or equal to 50 μm and smaller than or equal to 90 μm, or more preferably, greater than or equal to 60 μm and smaller than or equal to 90 μm.

The average distance between projections and depressions on the sliding surface is greater than or equal to 700 μm and smaller than or equal to 1600 μm, or preferably, from the viewpoint of preventing a rise of the driving torque and preventing the brightness from varying, greater than or equal to 800 μm and smaller than or equal to 1600 μm, or more preferably, greater than or equal to 900 μm and smaller than or equal to 1600 μm.

When the projection/depression average height on the sliding surface is denoted with WCM, and the average distance between projections and depressions on the sliding surface is denoted with WSm, WCM and WSm preferably satisfy the following formula 1 from the viewpoint of preventing a rise of the driving torque and preventing the brightness from varying, and WCM and WSm more preferably satisfy the following formula 2, and further preferably satisfy the following formula 3:

$$0.025\times WSm\leq WCM\leq 0.129\times WSm \quad \text{Formula 1;}$$

$$0.031\times WSm\leq WCM\leq 0.113\times WSm \quad \text{Formula 2; and}$$

$$0.038x\ WSm\leq WCM0.100\times WSm \quad \text{Formula 3.}$$

Examples of a method for controlling the projection/depression average height on the sliding surface and the average distance between projections and depressions within the above ranges include a method for adjusting the thickness of warp and weft constituting the woven base, distance between the warp and the weft, and the thickness of the cover layer.

Layers constituting the sliding member according to the present exemplary embodiment will now be specifically described, below. In the following description, reference sings will be omitted.

(Woven Base)

Examples of a woven base include a woven fabric from weaving yarns of heat-resistant fibers having mechanical strength such as a glass fiber, a carbon fiber, or an aramid fiber. Among these, from the viewpoint of controllability of projections and depressions on the sliding surface, a woven fabric containing at least one from the group of glass fibers and aramid fibers is preferable as a woven base, or a woven fabric containing a glass fiber (glass cloth) is further preferable.

A glass fiber is not limited to a particular one, and examples of the glass fiber include a known glass fiber such as E glass, S glass, and C glass.

Preferably, the filament of the glass fiber has a diameter (width) of greater than or equal to 3 μm and smaller than or equal to 10 μm (preferably, greater than or equal to 4 μm and smaller than or equal to 8 μm).

Preferably, a glass fiber formed from a bundle of 150 to 500 (preferably, 200 to 400) filaments of a glass fiber is used as the glass fiber.

The average diameter of the weaving yarns constituting the woven base is greater than or equal to 20 μm and smaller than or equal to 100 μm, or preferably, from the viewpoint of preventing a rise of the driving torque and preventing the brightness from varying, greater than or equal to 30 μm and smaller than or equal to 90 μm, and more preferably, greater than or equal to 40 μm and smaller than or equal to 80 μm.

In the case of the woven base formed from multiple types of weaving yarn, at least one type of weaving yarn may have the average diameter falling within the above range, but preferably, the thickest weaving yarn has the average diameter falling within the above range.

Here, the average diameter of the weaving yarn refers to the equivalent circle diameter in a cross section taken perpendicular to the longitudinal direction of the weaving yarn. Specifically, the equivalent circle diameter is obtained by observing, with SEM, the cross section of the weaving yarn taken perpendicular to the longitudinal direction with a general-purpose cutter. The average of the equivalent circle diameters obtained at five points is referred to as the "average diameter".

The glass-fiber woven fabric may have any weave structure, such as a plain weave, a satin weave, a twill weave, a leno weave, or a mock leno weave. Among these, a plain weave is preferable for its high mechanical strength. In the case of, for example, a glass-fiber woven fabric of a plain weave, the distance between the glass fiber bundles formed into the plain weave is preferably greater than or equal to 0.7 mm and smaller than or equal to 1.6 mm (preferably, greater than or equal to from 0.8 mm and smaller than or equal to 1.6 mm).

Preferably, the base has a thickness of greater than or equal to 50 μm and smaller than or equal to 250 μm, and more preferably, greater than or equal to 70 μm and smaller than or equal to 230 μm from the viewpoint of strength and flexural rigidity.

(Cover Layer)

The cover layer preferably contains resin such as fluororesin, polyimide resin, polyamide resin, or polyamide-imide resin. Among these, fluororesin is most preferable.

Examples of fluororesin include polytetrafluoroethylene (PTFE), perfluoroalkoxy alkane (PFA), tetrafluoroetylene-hexafluoropropylen copolymer (FEP), ethylene-tetrafluoroethylene copolymer (ETFE), or a modification of any of these. The surface of the cover layer serves as a sliding surface. From the viewpoint of reducing the coefficient of friction on the sliding surface for enhancing the sliding performance, PTFE or a modification of PTFE is preferably used among the above examples of fluororesin.

Besides fluororesin, the cover layer may contain, for example, an electroconductive carbon as another additive, as needed. Preferably, the content of other additives is greater than or equal to 5 parts by mass and smaller than or equal to 10 parts by mass for 100 parts by mass of fluororesin.

Preferably, the cover layer has an average thickness of greater than or equal to 25 μm and smaller than or equal to 60 μm, or from the viewpoint of preventing cracking or breaking of the cover layer and controlling the projections and the depressions on the sliding surface, the average thickness is greater than or equal to 27 μm and smaller than or equal to 57 μm. Preferably, the average thickness is greater than or equal to 30 μm and smaller than or equal to 55 μm.

Method for Manufacturing Sliding Member

A method for manufacturing the sliding member according to the present exemplary embodiment is not limited to a particular one, and includes the following examples.

First, a base is prepared.

Then, for example, a material that forms a cover layer and the base are bonded together with pressure. For example, to dispose cover layers containing fluororesin on both surfaces of the base made of a glass-fiber woven fabric, the glass-fiber woven fabric is held between two fluororesin films to be bonded together with pressure.

Fixing Device

A fixing device according to the present exemplary embodiment includes a first rotator, a second rotator disposed in contact with an outer circumferential surface of the first rotator, a pressing member disposed inside the second rotator to press the second rotator against the first rotator from the inner circumferential surface of the second rotator, a sliding member according to the present exemplary embodiment interposed between the inner circumferential surface of the second rotator and the pressing member, the sliding member having a sliding surface in contact with the inner circumferential surface of the second rotator, and a heat source that heats at least one of the first rotator and the second rotator.

The fixing device according to the present exemplary embodiment may further include a lubricant feeder that feeds a lubricant to the sliding surface.

The fixing device according to the present exemplary embodiment may have any of various different structures, but the following two exemplary embodiments will be specifically described.

As a first exemplary embodiment, a fixing device including a heating roller including a heat source, and a pressing belt against which a pressing pad is pressed will be described.

As a second exemplary embodiment, a fixing device including a heating belt having a heat source and against which a pressing pad is pressed, and a pressing roller will be described.

The sliding member according to the present exemplary embodiment is used as a sliding member of each of these fixing devices.

Fixing Device According to First Exemplary Embodiment

Figure 3:
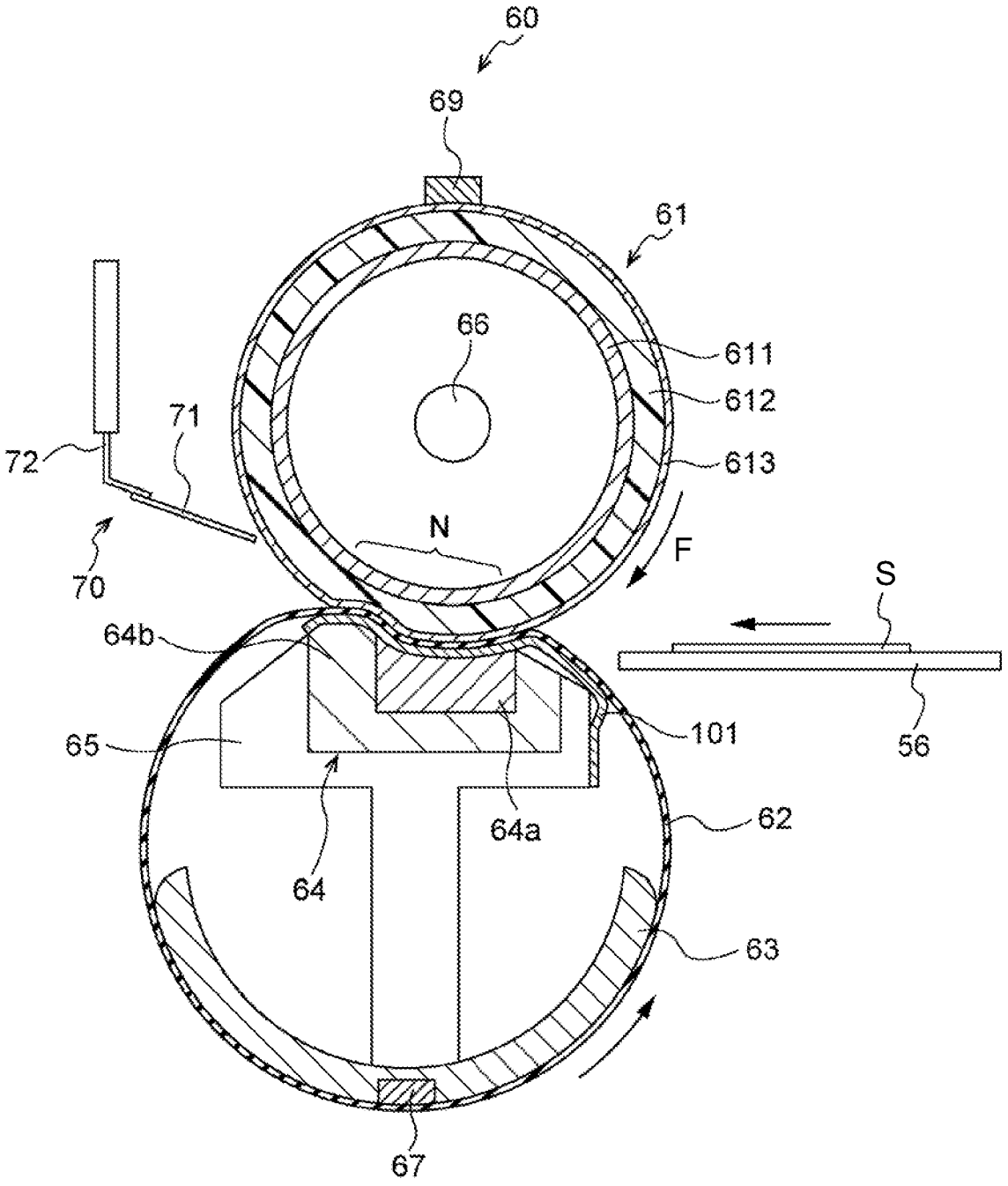
FIG. 3 is a schematic diagram of an example of a structure of a fixing device according to the present exemplary embodiment.

FIG. 3 is a schematic diagram of the structure of a fixing device 60 according to the first exemplary embodiment.

The fixing device 60 includes a heating roller 61 (an example of a first rotator), a pressing belt 62 (an example of a second rotator), a pressing pad 64 (an example of a pressing member), a sliding member 101 (an example of the sliding member according to the present exemplary embodiment), and a halogen lamp 66 (an example of a heat source).

The heating roller 61 and the pressing belt 62 come into contact with each other on the outer circumferential surfaces and press against each other. The pressing belt 62 may press against the heating roller 61, or the heating roller 61 may press against the pressing belt 62. The area over which the heating roller 61 and the pressing belt 62 are in contact with each other forms a holding area N (nip portion).

The heating roller 61 includes the halogen lamp 66 (an example of a heat source) inside. Instead of a halogen lamp, the heat source may be another heating member.

A temperature sensor 69 is disposed in contact with the outer circumferential surface of the heating roller 61. Turning on/off of the halogen lamp 66 is controlled on the basis of temperature values measured by the temperature sensor 69, so that the heating roller 61 keeps a set surface temperature (for example, 150° C.)

The heating roller 61 is formed by, for example, laminating a heat-resistant elastic layer 612 and a separation layer 613 in this order on the circumference of a metal core (hollow cylindrical metal core) 611.

The pressing belt 62 is disposed in contact with the outer circumferential surface of the heating roller 61. The pressing belt 62 is endless, and formed by laminating, for example, a base layer, an elastic layer, and a separation layer one on another. The base layer of the pressing belt 62 serving as an inner circumferential surface may be formed from, for example, a heat-resistant resin. Specific examples of a heat-resistant resin include polyimide and polyamide-imide.

The pressing belt 62 is rotatably supported by the pressing pad 64 and a belt travel guide 63, which are disposed inside the pressing belt 62.

The pressing pad 64 is disposed inside the pressing belt 62 to be pressed against the heating roller 61 with the pressing belt 62 interposed therebetween.

The pressing pad 64 includes a front nip portion **64*a* at the entrance of the holding area N, and a separation nip portion 64*b*** at the exit of the holding area N.

The front nip portion 64*a* has a concave shape to follow the outer profile of the heating roller 61 and to secure the length of the holding area N (distance in a slide direction).

The separation nip portion 64*b* has a convex shape to protrude toward the outer circumferential surface of the heating roller 61 and to cause local distortion on the heating roller 61 at the exit of the holding area N. The separation nip portion 64*b* thus facilitates separation of the fixed recording medium from the heating roller 61.

The sliding member 101 is disposed between the pressing belt 62 and the pressing pad 64 while having its sliding surface in contact with the inner circumferential surface of the pressing belt 62, serving as the receiving member.

The sliding member 101 is disposed to cover the front nip portion 64*a* and the separation nip portion 64*b* to reduce the sliding resistance between the pressing pad 64 and the inner circumferential surface of the pressing belt 62.

A support member 65 supports the pressing pad 64 and the sliding member 101. The support member 65 is formed from, for example, metal.

The belt travel guide 63 is attached to the support member 65. The pressing belt 62 rotates along the belt travel guide 63.

A lubricant feeder 67, which is a device that feeds a lubricant (such as oil) to the inner circumferential surface of the pressing belt 62, may be attached to the belt travel guide 63.

Examples of a lubricant include silicone oil, fluorine oil, and fluorine grease. The lubricant may contain, for example, an antioxidant or a thickener. For example, the viscosity of the lubricant at 150° C. is greater than or equal to 5 $mm^2/s$ and smaller than or equal to 100 $mm^2/s$, preferably greater than or equal to 10 $mm^2/s$ and smaller than or equal to 80 $mm^2/s$, or more preferably greater than or equal to 20 $mm^2/s$ and smaller than or equal to 60 $mm^2/s$.

A separation member 70 that helps separation of a recording medium is disposed downstream of the holding area N. The separation member 70 includes a separation lug 71, and a holding member 72, which holds the separation lug 71. The separation lug 71 is disposed adjacent to the heating roller 61 to extend in the direction against the rotation direction of the heating roller 61 (extend in a counter direction).

The heating roller 61 is rotated in the direction of arrow F by a driving device (not illustrated), and the pressing belt 62 is driven by this rotation to rotate in the direction opposite to the rotation direction of the heating roller 61.

A sheet S (recording medium) carrying an unfixed toner image is guided by a fixing entrance guide 56 to the holding area N. When the sheet S passes the holding area N, the toner image on the sheet S is fixed to the sheet with pressure and heat exerted over the holding area N.

Fixing Device According to Second Exemplary Embodiment

Figure 4:
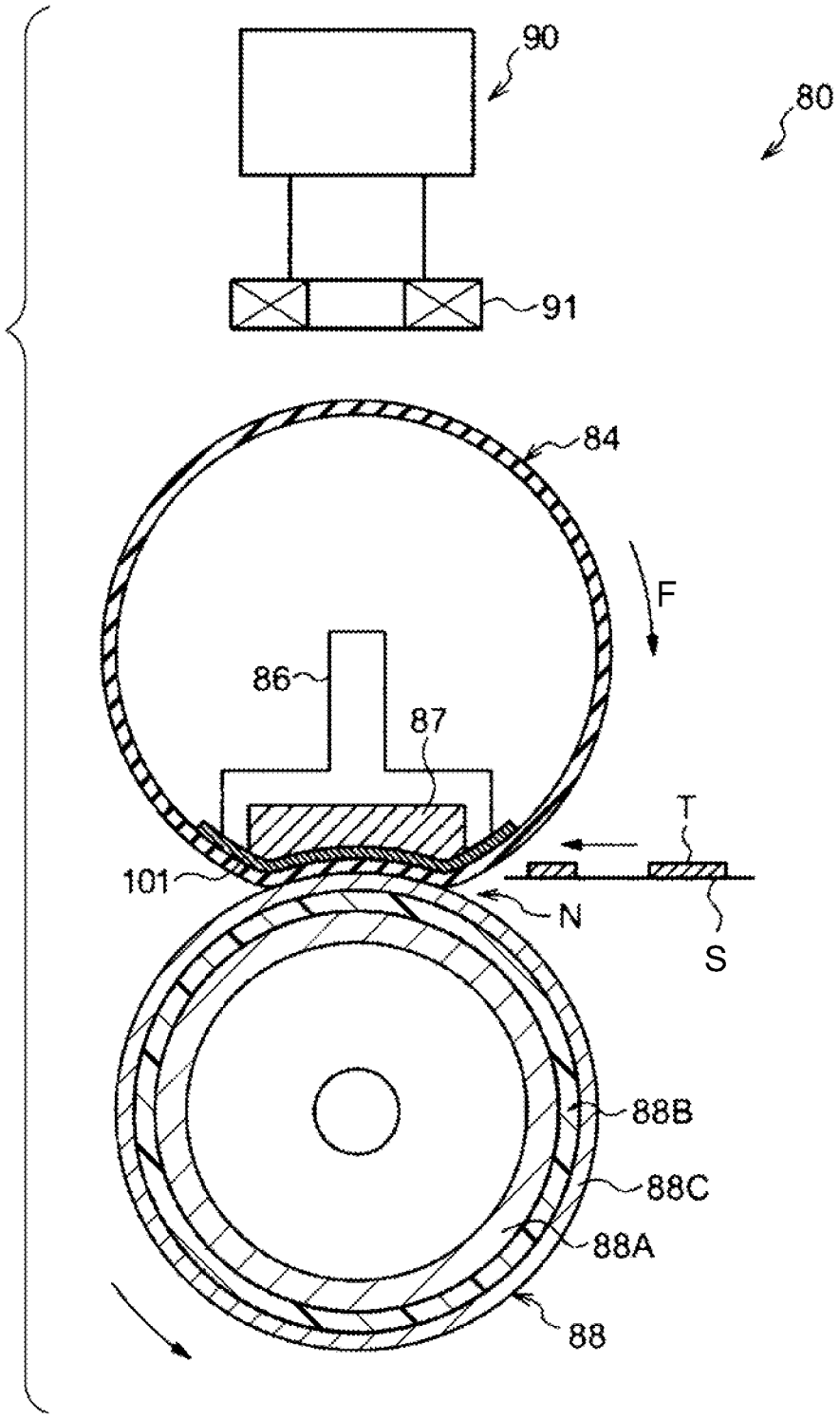
FIG. 4 is a schematic diagram of another example of a structure of a fixing device according to the present exemplary embodiment.

FIG. 4 is a schematic diagram of the structure of a fixing device 80 according to a second exemplary embodiment.

The fixing device 80 is an electromagnetic-induction-heating fixing device that includes a pressing roller 88 (an example of a first rotator), a heating belt 84 (an example of a second rotator), a pressing pad 87 (an example of a pressing member), a sliding member 101 (an example of the sliding member according to the present exemplary embodiment), and an electromagnetic induction device 90 (example of a heat source).

The pressing roller 88 is disposed to be pressed against the outer circumferential surface of the heating belt 84 to form a holding area N (nip portion) in the area over which the pressing roller 88 and the heating belt 84 are in contact with each other.

The pressing roller 88 includes, for example, a base layer 88A, an elastic layer 88B, and a separation layer 88C.

The heating belt 84 is endless, and formed by laminating, for example, a base layer, a heating layer, an elastic layer, and a separation layer one on another in this order from the inner side. The heating layer generates heat through electromagnetic induction.

The pressing pad 87 is disposed on the inner side of the heating belt 84 across from the pressing roller 88. The pressing pad 87 is supported by a support member 86. The heating belt 84 is wound around the pressing pad 87. The pressing pad 87 presses the heating belt 84 against the pressing roller 88. The pressing pad 87 is formed from, for example, metal, heat-resistant resin, or heat-resistant rubber.

For example, the fixing device may include a lubricant feeder (not illustrated), which feeds a lubricant (such as oil) to the inner circumferential surface of the heating belt 84, upstream of the pressing pad 87.

Examples of a lubricant include those used for the fixing device according to the first exemplary embodiment.

The sliding member 101 is disposed between the heating belt 84 and the pressing pad 87 to have its sliding surface in contact with the inner circumferential surface of the heating belt 84 serving as a receiving member.

The electromagnetic induction device 90 is disposed across from the pressing roller 88 with the heating belt 84 interposed therebetween. The electromagnetic induction device 90 causes the heating layer of the heating belt 84 to generate heat through electromagnetic induction.

The electromagnetic induction device 90 includes an electromagnetic induction coil (exciting coil) 91. The electromagnetic induction device 90 imposes an alternating current on the electromagnetic induction coil 91 to cause a magnetic field, and the magnetic field is changed by an exciting circuit to cause eddy current in the heating layer of the heating belt 84. This eddy current is converted into heat (Joule's heat) with electric resistance of the heating layer, so that the surface of the heating belt 84 generates heat.

The heating belt 84 is rotated in the direction of arrow F by a driving device (not illustrated), and the pressing roller 88 is driven by this rotation to rotate in the direction opposite to the rotation direction of the heating belt 84.

A sheet S (recording medium) carrying an unfixed toner image T is transported to the holding area N of the fixing device 80. When the sheet S passes the holding area N, the toner image on the sheet S is fixed to the sheet S with pressure and heat exerted over the holding area N.

Image Forming Apparatus

An image forming apparatus according to the present exemplary embodiment includes an image carrier, a charging device that charges the surface of the image carrier, a latent-image forming device that forms a latent image on the charged surface of the image carrier, a developing device that develops the latent image with toner into a toner image, a transfer device that transfers the toner image to a recording medium, and a fixing device according to the present exemplary embodiment that fixes the toner image to the recording medium.

Hereinbelow, the image forming apparatus according to the present exemplary embodiment will be described using an electrophotographic image forming apparatus by way of example. The image forming apparatus according to the present exemplary embodiment is not limited to an electrophotographic image forming apparatus, but may be a known image forming apparatus other than the electrophotographic image forming apparatus (such as an inkjet recording device including a sheet-transport endless belt).

Figure 5:
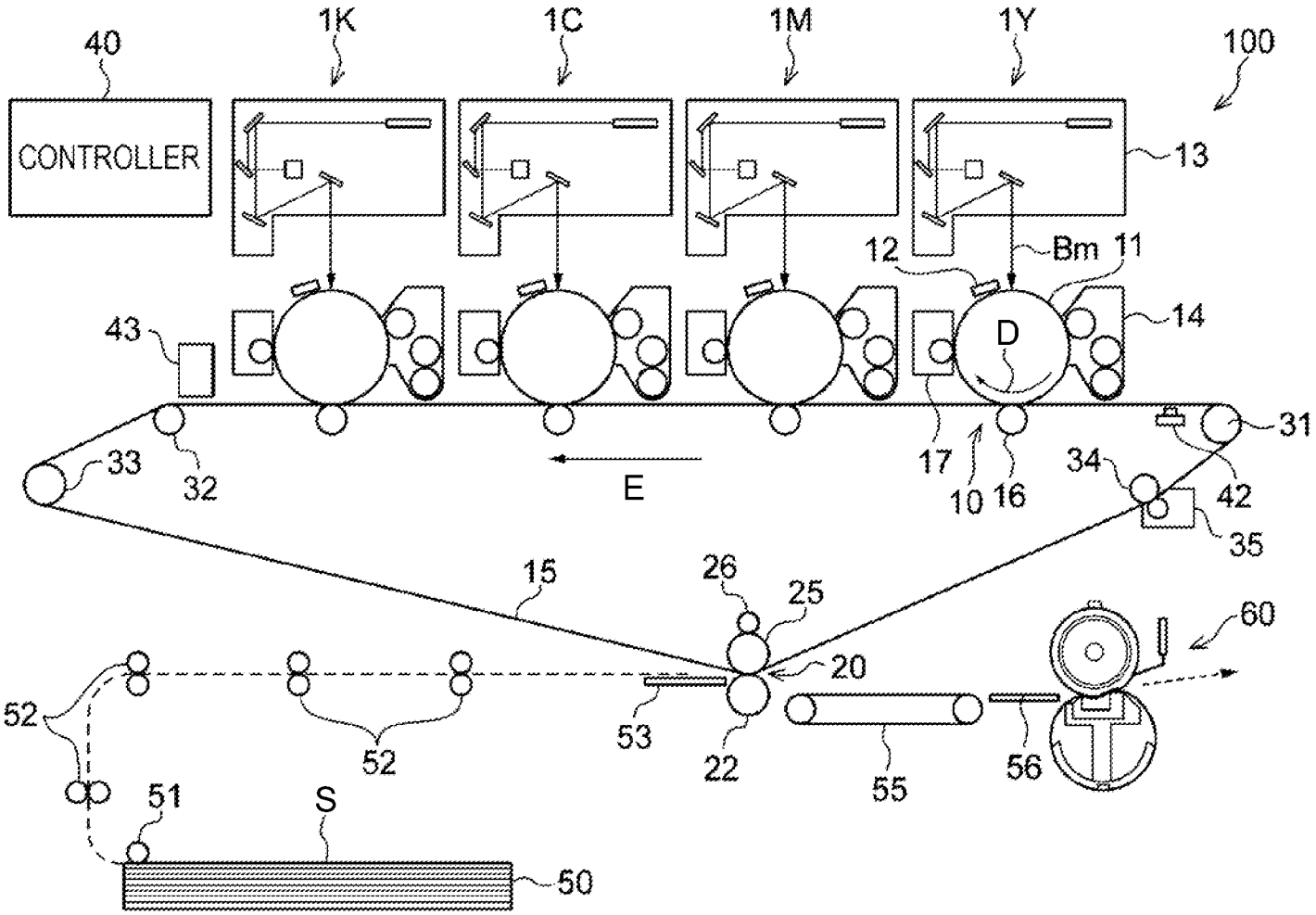
FIG. 5 is a schematic diagram of an example of a structure of an image forming apparatus according to the present exemplary embodiment.

FIG. 5 is a schematic diagram of an example of the structure of an image forming apparatus 100 according to the present exemplary embodiment. The image forming apparatus 100 includes the above-described fixing device 60 according to the first exemplary embodiment. Instead of the fixing device 60, the image forming apparatus 100 may include the above-described fixing device 80 according to the second exemplary embodiment.

The image forming apparatus 100 is an intermediate-transfer image forming apparatus, generally called a tandem image forming apparatus. The image forming apparatus 100 includes image forming units 1Y, 1M, 1C, and 1K, which form toner images of respective colors through electrophotography, first transfer portions 10, which sequentially transfer (first-transfer) different-colored toner images to an intermediate transfer belt 15, a second transfer portion 20, which collectively transfers (second-transfers) the superposed toner images transferred to the intermediate transfer belt 15 to a sheet S serving as a recording medium, the fixing device 60, which fixes the second-transferred images to the sheet S, and a controller 40, which controls the operation of the devices (units).

The image forming units 1Y, 1M, 1C, and 1K are substantially linearly arranged in order from 1Y (yellow unit), 1M (magenta unit), 1C (cyan unit), and 1K (black unit) from the upstream side of the intermediate transfer belt 15.

Each of the image forming units 1Y, 1M, 1C, and 1K includes a photoconductor 11 (an example of an image carrier). The photoconductor 11 rotates in the direction of arrow D.

Around each photoconductor 11, a charger 12 (an example of a charging device), a laser exposing device 13 (an example of a latent-image forming device), a developing device 14 (an example of a developing device), a first transfer roller 16, and a photoconductor cleaner 17 are sequentially arranged in the rotation direction of the photoconductor 11.

The charger 12 charges the surface of the corresponding photoconductor 11.

The laser exposing device 13 emits an exposure beam Bm to form an electrostatic latent image on the photoconductor 11.

The developing device 14 contains toner of the corresponding color to develop the electrostatic latent image on the corresponding photoconductor 11 with toner into a visible toner image.

The first transfer roller 16 transfers the toner image formed on the corresponding photoconductor 11 to the intermediate transfer belt 15 at the first transfer portion 10.

The photoconductor cleaner 17 removes remaining toner on the corresponding photoconductor 11.

The intermediate transfer belt 15 is a belt made of materials containing resin, such as polyimide or polyamide, and an antistatic agent such as carbon black added to the resin. The intermediate transfer belt 15 has a volume resistivity of greater than or equal to, for example, $10^6$ Ωcm and smaller than or equal to $10^{14}$ Ωcm, and a thickness of, for example, 0.1 mm.

The intermediate transfer belt 15 is supported by a driving roller 31, a support roller 32, a tensioning roller 33, a backup roller 25, and a cleaning backup roller 34, and circularly driven (rotated) in the direction of arrow E with the rotation of the driving roller 31.

The driving roller 31 is driven by a motor (not illustrated) that operates at a fixed speed to rotate the intermediate transfer belt 15.

The support roller 32 supports, together with the driving roller 31, the intermediate transfer belt 15, which extends substantially linearly in the direction in which the four photoconductors 11 are arranged.

The tensioning roller 33 exerts a predetermined tension on the intermediate transfer belt 15, and functions as a correction roller that prevents the intermediate transfer belt 15 from deviating.

The backup roller 25 is disposed on the second transfer portion 20, and the cleaning backup roller 34 is disposed at a cleaning unit that scratches the remaining toner off the intermediate transfer belt 15.

Each first transfer roller 16 is pressed against the corresponding photoconductor 11 with pressure with the intermediate transfer belt 15 interposed therebetween to form the first transfer portion 10.

Each first transfer roller 16 receives a voltage having a polarity (first transfer bias) opposite to the polarity of the voltage with which the toner is charged (negative polarity, the same holds true for the following). Thus, the toner images on the respective photoconductors 11 are sequentially electrostatically attracted to the intermediate transfer belt 15, and form superposed toner images on the intermediate transfer belt 15.

Each first transfer roller 16 is a hollow cylindrical roller including a shaft (such as a cylindrical metal stick made of iron or stainless steel), and an elastic layer (such as a sponge layer made of a blend rubber in which an electroconductive agent such as carbon black is mixed) fixed to the circumference of the shaft. The first transfer roller 16 has a volume resistivity of greater than or equal to, for example, $10^{7.5}$ Ωcm and smaller than or equal to $10^{8.5}$ Ωcm.

A second transfer roller 22 is pressed against the backup roller 25 with the intermediate transfer belt 15 interposed therebetween to form the second transfer portion 20.

The second transfer roller 22 forms a second transfer bias between itself and the backup roller 25 to second-transfer the toner image onto a sheet S (recording medium) transported by the second transfer portion 20.

The second transfer roller 22 is a hollow cylindrical roller including a shaft (such as a cylindrical metal stick made of iron or stainless steel) and an elastic layer (such as a sponge layer made of a blend rubber in which an electroconductive agent such as carbon black is mixed) fixed to the circumference of the shaft. The second transfer roller 22 has a volume resistivity of greater than or equal to, for example, $10^{7.5}$ Ωcm and smaller than or equal to $10^{8.5}$ Ωcm.

The backup roller 25 is disposed on the back surface of the intermediate transfer belt 15 to form a counter electrode for the second transfer roller 22 and to form a transfer electric field between itself and the second transfer roller 22.

The backup roller 25 is formed by covering, for example, a rubber base with a tube made of a blend rubber in which carbon is dispersed. The backup roller 25 has a surface resistivity of, for example, greater than or equal to $10^7$ Ω/sq and smaller than or equal to $10^{10}$ Ω/sq, and a hardness of, for example, 70° (Asker C: Kobunshi Keiki, the same holds true, below).

A power feed roller 26 made of metal is disposed in contact with the backup roller 25. The power feed roller 26 imposes a voltage (second transfer bias) having a polarity the same as that of the voltage with which the toner is charged (negative polarity) to form a transfer electric field between the second transfer roller 22 and the backup roller 25.

An intermediate-transfer-belt cleaner 35 is disposed downstream of the second transfer portion 20 of the intermediate transfer belt 15 to be movable toward and away from the intermediate transfer belt 15. The intermediate-transfer-belt cleaner 35 removes remaining toner or paper dust from the intermediate transfer belt 15 after the second transfer.

A reference sensor (home-position sensor) 42 is disposed upstream of the image forming unit 1Y. The reference sensor 42 generates reference signals serving as a reference for each of the image forming units to time the right moment for image forming. The reference sensor 42 recognizes a mark on the back surface of the intermediate transfer belt 15 and generates a reference signal. With an instruction from the controller 40 that has recognized this reference signal, the image forming units 1Y, 1M, 1C, and 1K start image formation.

An image density sensor 43, which adjusts the image quality, is disposed downstream of the image forming unit 1K.

The image forming apparatus 100 includes, as transport members for transporting the sheet S, a sheet container 50, a feed roller 51, transport rollers 52, a transport guide 53, a transport belt 55, and a fixing entrance guide 56.

The sheet container 50 accommodates sheets S before undergoing image formation.

The feed roller 51 picks up the sheets S accommodated in the sheet container 50.

The transport rollers 52 transport the sheets S picked up by the feed roller 51.

The transport guide 53 feeds the sheet S transported by the transport rollers 52 to the second transfer portion 20.

The transport belt 55 transports the sheet S to which an image has been transferred by the second transfer portion 20 to the fixing device 60.

The fixing entrance guide 56 guides the sheet S to the fixing device 60.

Subsequently, a method for forming an image with the image forming apparatus 100 will be described.

In the image forming apparatus 100, image data output from, for example, an image reading device (not illustrated) or a computer (not illustrated) is subjected to image processing by an image processing device (not illustrated), and subjected to an image forming operation by the image forming units 1Y, 1M, 1C, and 1K.

The image processing device performs image processing on the input reflectance data, such as shading correction, misalignment correction, brightness/color space conversion, gamma correction, frame removal, color editing, or displacement editing. Image data subjected to image processing is converted into four-color gradient data of Y, M, C, and K, and output to the laser exposing devices 13.

In accordance with the input color gradient data, the laser exposing devices 13 radiate exposure beams Bm to the photoconductors 11 of the image forming units 1Y, 1M, 1C, and 1K.

The surfaces of the photoconductors 11 of the image forming units 1Y, 1M, 1C, and 1K are charged by the chargers 12, and then scanned and exposed to light by the laser exposing devices 13 to allow electrostatic latent images to be formed thereon. The electrostatic latent image formed on each photoconductor 11 is developed by the corresponding image forming unit into a toner image of the corresponding color.

The toner image formed on the photoconductor 11 of each of the image forming units 1Y, 1M, 1C, and 1K is transferred to the intermediate transfer belt 15 at the first transfer portion 10 at which the photoconductor 11 and the intermediate transfer belt 15 come into contact with each other. At the first transfer portions 10, the first transfer rollers 16 impose to the intermediate transfer belt 15 a voltage (first transfer bias) having a polarity opposite to that of the voltage with which the toner is charged (negative polarity), and the toner images are sequentially transferred onto the intermediate transfer belt 15 in a superposed manner.

The toner images that have been first-transferred to the intermediate transfer belt 15 are transported to the second transfer portion 20 with the movement of the intermediate transfer belt 15.

At the timing at which the toner images arrive at the second transfer portion 20, a sheet S accommodated in the sheet container 50 is transported by the feed roller 51, the transport rollers 52, and the transport guide 53, fed to the second transfer portion 20, and held between the intermediate transfer belt 15 and the second transfer roller 22.

Then, at the second transfer portion 20 over which a transfer electric field is formed, the toner images on the intermediate transfer belt 15 are electrostatically transferred (second-transferred) to the sheet S.

The sheet S to which the toner images are electrostatically transferred is separated from the intermediate transfer belt 15 by the second transfer roller 22, and transported to the fixing device 60 by the transport belt 55.

The sheet S transported to the fixing device 60 is heated and pressed by the fixing device 60, to have the unfixed toner image fixed thereon.

With the above procedure, the image forming apparatus 100 forms an image on the sheet S, serving as a recording medium, without having creases on the sheet.

EXAMPLES

Hereinbelow, the present exemplary embodiment will be specifically described using examples, but the present exemplary embodiment is not limited to the examples, below.

Comparative Example 1

Manufacturing of Sheet-Shaped Sliding Member

Firstly, a PTFE resin (Daikin Industries, Ltd.) is filled in a predetermined mold, undergoes compression molding, and then heated and fired for 10 minutes at a temperature higher than or equal to the melting point (specifically, 350° C.) to be formed into a compact. Then, with a metal blade, the compact is formed into a thin film sheet (nonporous sheet) with an average thickness of 20 μm.

Thereafter, a glass cloth (thickness 40 μm) formed by weaving glass fiber bundles (specifically, weaving yarns with an average diameter of 10 μm) into a plain weave is dipped into and coated with fluororesin dispersion (Solvay S.A.) and allows the fluororesin dispersion to melt and be impregnated thereinto at 290° C. to obtain a glass cloth base having projections and depressions.

The glass cloth base having projections and depressions on its surface is held between two thin film sheets (nonporous sheets) to be stacked with each other, and undergoes thermocompression bonding for 10 minutes under a temperature of 300° C. and a pressure of 60 kg/cm$^2$ to obtain a sheet-shaped sliding member. Here, in order that the surface profile of the base surface (specifically, the cover-layer installed surface) along the projections and depressions is more likely to appear through the surface (sliding surface) of the nonporous sheet, a fluororubber sheet (Nitto Kako Co., Ltd.,) with a thickness of 2 mm is held between a pressing plate and the sheet-shaped sliding member to undergo processing (specifically, thermocompression bonding).

The projection/depression average height (WCM) and the average distance between projections and depressions (WSm) on the sliding surface of the obtained sheet-shaped sliding member are measured in the above method. Table 1 shows the results.

Evaluation of Sliding-Resistance Sustainability of Sheet-Shaped Sliding Member

As a test for checking the sliding-resistance sustainability of the sheet-shaped sliding member, the sheet-shaped sliding member is installed in a fixing device used in ApeosPort-VI C7771 from Fuji Xerox, and the driving torque of the fixing device during continuous sheet passage is measured. A lubricant used for the fixing device is silicone oil (having a viscosity of 40 $mm^2/s$ at 150° C.)

The sliding-resistance sustainability of the sheet-shaped sliding member is evaluated based on the number of sheets (life) that has passed when the driving torque arrives at the upper limit of the torque, that is, 0.7 N·m. Table 1 shows the results. The desired number of sheets that pass (life) is one million. A larger number of sheets (life) represents the sliding-resistance sustainability is more preferable.

Evaluation of Image Brightness Variation

In the test for checking the sliding-resistance sustainability, whether a fifth image (a blue solid image on an OS coated paper sheet of 127 gsm from Fuji Xerox) has uneven brightness is evaluated. Table 1 shows the results. In table 1, "A" denotes a preferable image quality without uneven brightness, "B" denotes that a pit of uneven brightness about the same as the average distance between projections and depressions of the sliding member in the sheet width direction is found.

Comparative Example 2

Except for using, as a glass cloth, a glass cloth (with a thickness of 45 μm) formed by weaving glass fiber bundles (specifically, weaving yarns with an average diameter of 15 μm) into a plain weave, the sheet-shaped sliding member is obtained in the same manner as in the comparative example 1.

The projection/depression average height (WCM) and the average distance between projections and depressions (WSm) on the sliding surface of the obtained sheet-shaped sliding member are measured in the above method. Table 1 shows the results.

In the same manner as in the comparative example 1, the sliding-resistance sustainability and the obtained image brightness variation of the sheet-shaped sliding member are evaluated. Table 1 shows the results.

Example 1

A PTFE resin (Daikin Industries, Ltd.) is filled in a predetermined mold, undergoes compression molding, and then is heated and fired for 10 minutes at a temperature higher than or equal to the melting point (specifically, 350° C.) to be formed into a compact. Then, with a metal blade, the compact is formed into a thin film sheet (nonporous sheet) with an average thickness of 30 μm.

Except that a glass cloth (thickness of 50 μm) formed by weaving glass fiber bundles (specifically, weaving yarns with an average diameter of 20 μm) into a plain weave is used as a glass cloth and the obtained thin film sheets are used for two thin film sheets, the sheet-shaped sliding member is obtained in the same manner as in the case of the comparative example 1.

The projection/depression average height (WCM) and the average distance between projections and depressions (WSm) on the sliding surface of the obtained sheet-shaped sliding member are measured in the above-described manner. Table 1 shows the results.

In the same manner as in the comparative example 1, the sliding-resistance sustainability and the obtained image brightness variation of the sheet-shaped sliding member are evaluated. Table 1 shows the results.

Example 2

Except for using, as a glass cloth, a glass cloth (with a thickness of 100 μm) formed by weaving glass fiber bundles (specifically, weaving yarns with an average diameter of 50 μm) into a plain weave, the sheet-shaped sliding member is obtained in the same manner as in the comparative example 1.

The projection/depression average height (WCM) and the average distance between projections and depressions (WSm) on the sliding surface of the obtained sheet-shaped sliding member are measured in the above method. Table 1 shows the results.

In the same manner as in the comparative example 1, the sliding-resistance sustainability and the obtained image brightness variation of the sheet-shaped sliding member are evaluated. Table 1 shows the results.

Comparative Example 3

Except for using, as a glass cloth, a glass cloth (with a thickness of 260 μm) formed by weaving glass fiber bundles (specifically, weaving yarns with an average diameter of 110 μm) into a plain weave, the sheet-shaped sliding member is obtained in the same manner as in the comparative example 1.

The projection/depression average height (WCM) and the average distance between projections and depressions (WSm) on the sliding surface of the obtained sheet-shaped sliding member are measured in the above method. Table 1 shows the results.

In the same manner as in the comparative example 1, the sliding-resistance sustainability and the obtained image brightness variation of the sheet-shaped sliding member are evaluated. Table 1 shows the results.

TABLE 1

| | Sliding Sheet Specifications | | Performance Results | |
|---|---|---|---|---|
| | Projection/ Depression Average Height (WCM) | Average Distance Between Projections and Depressions (WSm) | Sliding-Resistance Sustainability | Brightness Variation |
| Comparative Example 1 | 15 | 600 | 300 thousand | A |
| Comparative Example 2 | 30 | 800 | 600 thousand | A |
| Example 1 | 40 | 900 | 1 million | A |

TABLE 1-continued

| | Sliding Sheet Specifications | | | |
|---|---|---|---|---|
| | Projection/ Depression | Average Distance Between | Performance Results | |
| | Average Height (WCM) | Projections and Depressions (WSm) | Sliding-Resistance Sustainability | Brightness Variation |
| Example 2 | 70 | 1600 | 1 million 500 thousand | A |
| Comparative Example 3 | 80 | 1800 | 1 million 700 thousand | B |

The sliding members according to the examples have preferable evaluations in sliding-resistance sustainability and brightness variation than the sliding members according to the comparative examples.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image-forming-apparatus sliding member, comprising:

a woven base; and a cover layer disposed on at least one surface of the woven base, wherein an average height of projections and depressions on a sliding surface of the image-forming-apparatus sliding member is greater than or equal to 40 μm and smaller than or equal to 90 μm, and an average distance between the projections and the depressions is greater than or equal to 700 μm and smaller than or equal to 1600 μm.

2. The image-forming-apparatus sliding member according to claim 1, wherein the average height of the projections and the depressions is greater than or equal to 50 μm and smaller than or equal to 90 μm, and the average distance between the projections and the depressions is greater than or equal to 800 μm and smaller than or equal to 1600 μm.

3. The image-forming-apparatus sliding member according to claim 2, wherein the average height of the projections and the depressions is greater than or equal to 60 μm and smaller than or equal to 90 μm, and the average distance between projections and depressions is greater than or equal to 900 μm and smaller than or equal to 1600 μm.

4. The image-forming-apparatus sliding member according to claim 1, wherein when the average height of the projections and the depressions is denoted with WCM and the average distance between the projections and the depressions is denoted with WSm, WCM and WSm satisfy Formula 1, below:

$$0.025x\ WSm \leq WCM \cdot 0.129 \times WSm \qquad \text{Formula 1.}$$

5. The image-forming-apparatus sliding member according to claim 1, wherein the cover layer has an average thickness of greater than or equal to 25 μm and smaller than or equal to 60 μm.

6. The image-forming-apparatus sliding member according to claim 5, wherein the cover layer has an average thickness of greater than or equal to 30 μm and smaller than or equal to 55 μm.

7. The image-forming-apparatus sliding member according to claim 1, wherein the woven base contains one fiber selected from a group consisting of glass fibers and aramid fibers.

8. The image-forming-apparatus sliding member according to claim 1, wherein the cover layer contains fluororesin.

9. The image-forming-apparatus sliding member according to claim 8, wherein the fluororesin contains polytetrafluoroethylene.

10. A fixing device, comprising:

a first rotator;

a second rotator disposed in contact with an outer circumferential surface of the first rotator;

a pressing member disposed inside the second rotator, and pressing the second rotator against the first rotator from an inner circumferential surface of the second rotator;

the image-forming-apparatus sliding member according to claim 1 interposed between the inner circumferential surface of the second rotator and the pressing member, the image-forming-apparatus sliding member having a sliding surface in contact with the inner circumferential surface of the second rotator; and a heat source configured to heat at least one of the first rotator and the second rotator.

11. The fixing device according to claim 10, further comprising a lubricant feeder configured to feed a lubricant to the sliding surface of the image-forming-apparatus sliding member.

12. An image forming apparatus, comprising:

an image carrier;

a charging device configured to charge a surface of the image carrier;

a latent-image forming device configured to form a latent image on the charged surface of the image carrier;

a developing device configured to develop the latent image with toner into a toner image;

a transfer device configured to transfer the toner image to a recording medium; and the fixing device according to claim 10 configured to fix the toner image onto the recording medium.

13. An image-forming-apparatus sliding member, comprising:

a woven base including a weaving yarn having an average diameter greater than or equal to 20 μm and smaller than or equal to 100 μm; and a cover layer disposed on at least one surface of the woven base, and having an average thickness of greater than or equal to 25 μm and smaller than or equal to 60 μm.

14. The image-forming-apparatus sliding member according to claim 13, wherein the average thickness of the cover layer is greater than or equal to 30 μm and smaller than or equal to 55 μm.

* * * * *